US007845507B2

(12) United States Patent
Kellogg et al.

(10) Patent No.: US 7,845,507 B2
(45) Date of Patent: Dec. 7, 2010

(54) COLLAPSIBLE CONTAINER HAVING DISCONTINUOUS FRAME MEMBERS

(75) Inventors: Michael S. Kellogg, Oconomowoc, WI (US); Dean B. Krotts, Milwaukee, WI (US)

(73) Assignee: Bajer Design & Marketing, Inc., Waukesha, WI (US)

( * ) Notice: Subject to any disclaimer, the term of this patent is extended or adjusted under 35 U.S.C. 154(b) by 315 days.

(21) Appl. No.: 12/074,675

(22) Filed: Mar. 5, 2008

(65) Prior Publication Data

US 2009/0223954 A1 Sep. 10, 2009

(51) Int. Cl.

| | |
|---|---|
| ***B65D 6/00*** | (2006.01) |
| ***B65D 33/02*** | (2006.01) |
| ***B65D 8/04*** | (2006.01) |
| ***A45C 13/04*** | (2006.01) |
| ***A45C 13/26*** | (2006.01) |

(52) U.S. Cl. ..... 220/6; 220/9.1; 220/9.2; 220/9.3; 220/9.4; 220/666

(58) Field of Classification Search ..... 220/6, 220/9.1–9.4, 666, 752

See application file for complete search history.

(56) References Cited

U.S. PATENT DOCUMENTS

| | | | |
|---|---|---|---|
| 177,749 | A | 3/1876 | Redden |
| 216,227 | A | 6/1879 | Sedgwick |
| 217,362 | A | 7/1879 | Gardner |
| 218,277 | A | 8/1879 | Kilham |
| 251,325 | A | 12/1881 | Walters |
| 338,892 | A | 3/1886 | Walker |
| 344,340 | A | 6/1886 | Barrow |
| 356,301 | A | 1/1887 | Belknap |
| 414,622 | A | 11/1889 | Willits |
| 481,957 | A | 9/1892 | Klank |
| 665,942 | A | 1/1901 | Tabler |
| 929,430 | A | 7/1909 | Hill |
| 945,918 | A | 1/1910 | Crawford |
| 975,745 | A | 11/1910 | Bower |

(Continued)

FOREIGN PATENT DOCUMENTS

| | | |
|---|---|---|
| DE | 281680 | 8/1913 |

(Continued)

OTHER PUBLICATIONS

"Magic Maaze" Frongate Mail-Order Catalog, Summer 1995, p. 32.

(Continued)

*Primary Examiner*—Anthony Stashick
*Assistant Examiner*—Madison L Wright
(74) *Attorney, Agent, or Firm*—Ryan Kromholz & Manion, S.C.

(57) ABSTRACT

A collapsible container according to the present invention comprises a plurality of side panels and a floor panel forming an enclosure having an open top. Each side panel comprises a flexible frame, a web of material, and an edging material. At least one of the panel frames comprises a discontinuous loop. The edging envelops the frame and is coupled to the periphery of the web. One or more handles may be attached to the container or formed within one or more of the side panels. A method of making and collapsing the container is also disclosed.

21 Claims, 9 Drawing Sheets

U.S. PATENT DOCUMENTS

| | | | |
|---|---|---|---|
| 1,087,702 | A | 2/1914 | Van Patten |
| 1,135,892 | A | 4/1915 | Grosenbeck |
| 1,144,643 | A | 6/1915 | Elkins |
| 1,155,475 | A | 10/1915 | Fay |
| 1,167,497 | A | 1/1916 | Hayes |
| 1,180,574 | A | 4/1916 | Despot |
| 1,181,829 | A | 5/1916 | Bower |
| 1,206,618 | A | 11/1916 | Thrasher |
| 1,251,560 | A | 1/1918 | Myskow |
| 1,263,294 | A | 4/1918 | Taylor |
| 1,308,268 | A | 7/1919 | Wagner et al. |
| 1,360,844 | A | 11/1920 | Williams |
| 1,394,007 | A | 10/1921 | Hall |
| 1,520,532 | A | 12/1924 | Clark |
| 1,538,260 | A | 5/1925 | Street et al. |
| 1,581,888 | A | 4/1926 | Thomas |
| 1,583,083 | A | 5/1926 | Macaraig |
| 1,640,083 | A | 8/1927 | Ladd |
| 1,647,679 | A | 11/1927 | Williams |
| 1,691,904 | A | 11/1928 | Gamble |
| 1,703,066 | A | 2/1929 | Horn |
| 1,832,715 | A | 11/1931 | London |
| 1,836,297 | A | 12/1931 | Vienna |
| 1,979,978 | A | 11/1934 | Martin |
| 1,994,235 | A | 3/1935 | Solomon |
| 1,999,424 | A | 4/1935 | Seitz |
| 2,009,035 | A | 7/1935 | Towers |
| 2,016,520 | A | 10/1935 | Short |
| 2,042,888 | A | 6/1936 | Flood |
| 2,057,942 | A | 10/1936 | Fay |
| 2,071,850 | A | 2/1937 | Miller |
| 2,115,308 | A | 4/1938 | Koch |
| 2,136,761 | A | 11/1938 | Simmons |
| 2,182,932 | A | 12/1939 | Sanford |
| 2,269,574 | A | 1/1942 | Benenfeld |
| 2,280,601 | A | 4/1942 | Otter |
| 2,295,584 | A | 9/1942 | Larson |
| 2,298,786 | A | 10/1942 | Dubofsky et al. |
| 2,361,743 | A | 10/1944 | Butler |
| 2,517,757 | A | 8/1950 | Alderstein |
| 2,544,074 | A | 3/1951 | Ernst et al. |
| 2,575,893 | A | 11/1951 | Seaman |
| 2,600,501 | A | 6/1952 | Higgs |
| 2,625,973 | A | 1/1953 | Weldon et al. |
| 2,639,819 | A | 5/1953 | Marks |
| 2,664,131 | A | 12/1953 | Miller |
| 2,710,084 | A | 6/1955 | Braverman |
| 2,721,099 | A | 10/1955 | Rupp |
| 2,724,537 | A | 11/1955 | Fehr |
| 2,746,582 | A | 5/1956 | Cart |
| 2,761,480 | A | 9/1956 | Tames |
| 2,767,757 | A | 10/1956 | Marder |
| 2,778,560 | A | 1/1957 | Pfeiffer |
| 2,780,402 | A | 2/1957 | Zucker et al. |
| 2,833,460 | A | 5/1958 | Votolato |
| 2,879,553 | A | 3/1959 | Keating |
| 2,958,357 | A | 11/1960 | Vorgan |
| 3,014,516 | A | 12/1961 | Mueller |
| 3,017,117 | A | 1/1962 | Klingler |
| 3,061,396 | A | 10/1962 | Hock |
| 3,126,933 | A | 3/1964 | Mason et al. |
| 3,160,307 | A | 12/1964 | Morrison |
| 3,233,644 | A | 2/1966 | Bono |
| 3,257,077 | A | 6/1966 | Corning |
| 3,260,396 | A | 7/1966 | Buch |
| 3,265,284 | A | 8/1966 | Tompkins |
| 3,310,089 | A | 3/1967 | Silverman |
| 3,354,924 | A | 11/1967 | Birrell et al. |
| 3,373,925 | A | 3/1968 | Gatward |
| 3,410,328 | A | 11/1968 | Hideo Sasai |
| D213,131 | S | 1/1969 | Hamilton |
| 3,434,589 | A | 3/1969 | Valtri et al. |
| 3,439,865 | A | 4/1969 | Port et al. |
| D215,846 | S | 11/1969 | Curtin et al. |
| 3,480,059 | A | 11/1969 | Schoening |
| 3,502,091 | A | 3/1970 | Corbin |
| 3,583,748 | A | 6/1971 | Arndt |
| 3,603,367 | A | 9/1971 | Lehrman |
| 3,661,326 | A | 5/1972 | Wilson |
| 3,675,667 | A | 7/1972 | Miller |
| 3,675,981 | A | 7/1972 | Mallander |
| 3,696,850 | A | 10/1972 | Rosenblum |
| 3,709,237 | A | 1/1973 | Smith |
| 3,727,786 | A | 4/1973 | Fausel |
| 3,732,978 | A | 5/1973 | Reader |
| 3,733,758 | A | 5/1973 | Maier et al. |
| 3,796,342 | A | 3/1974 | Sanders et al. |
| 3,799,384 | A | 3/1974 | Hurkamp |
| 3,807,421 | A | 4/1974 | Geiger et al. |
| 3,834,528 | A | 9/1974 | Pickford et al. |
| 3,843,222 | A | 10/1974 | Berkun |
| 3,868,155 | A | 2/1975 | Cherubini |
| 3,880,459 | A | 4/1975 | Kelley |
| 3,883,026 | A | 5/1975 | Selz |
| 3,893,649 | A | 7/1975 | Cornell et al. |
| 3,935,958 | A | 2/1976 | Frangos |
| 3,946,903 | A | 3/1976 | Parker |
| 3,955,706 | A | 5/1976 | Whitaker |
| 3,960,161 | A | 6/1976 | Norman |
| 3,987,580 | A | 10/1976 | Ausnit |
| 3,990,463 | A | 11/1976 | Norman |
| 4,010,784 | A | 3/1977 | Nattrass et al. |
| 4,011,611 | A | 3/1977 | Lederman |
| 4,055,239 | A | 10/1977 | Weiner |
| 4,073,105 | A | 2/1978 | Daugherty |
| 4,094,639 | A | 6/1978 | McMillan |
| 4,118,089 | A | 10/1978 | Johnson et al. |
| 4,133,149 | A | 1/1979 | Angress |
| 4,134,225 | A | 1/1979 | Welch |
| 4,165,757 | A | 8/1979 | Marks |
| 4,170,082 | A | 10/1979 | Freedman |
| 4,180,113 | A | 12/1979 | Liebling |
| 4,195,804 | A | 4/1980 | Hujsak et al. |
| 4,212,130 | A | 7/1980 | Walker |
| 4,212,377 | A | 7/1980 | Weinreb |
| 4,246,945 | A | 1/1981 | Sterling |
| 4,248,278 | A | 2/1981 | Blodgett |
| 4,248,442 | A | 2/1981 | Barrett |
| 4,265,261 | A | 5/1981 | Barker |
| 4,287,701 | A | 9/1981 | Washington |
| 4,299,365 | A | 11/1981 | Battle |
| 4,304,068 | A | 12/1981 | Beder |
| 4,313,634 | A | 2/1982 | Williams |
| 4,352,457 | A | 10/1982 | Weick |
| 4,388,739 | A | 6/1983 | Martinon et al. |
| 4,401,213 | A | 8/1983 | Lerner |
| 4,411,300 | A | 10/1983 | Rico |
| 4,427,110 | A | 1/1984 | Shaw, Jr. |
| 4,428,484 | A | 1/1984 | Rattay et al. |
| D274,662 | S | 7/1984 | Fausel |
| 4,485,855 | A | 12/1984 | Dillingham |
| D279,249 | S | 6/1985 | Fausel |
| 4,580,776 | A | 4/1986 | Burkinshaw |
| 4,585,283 | A | 4/1986 | Redmon et al. |
| 4,603,432 | A | 7/1986 | Marino |
| 4,610,394 | A | 9/1986 | Bryson |
| 4,630,312 | A | 12/1986 | Milstein |
| 4,630,747 | A | 12/1986 | Chiang et al. |
| 4,632,138 | A | 12/1986 | Irwin |
| D288,019 | S | 1/1987 | Gebhard et al. |
| 4,635,411 | A | 1/1987 | Kurzen |
| 4,642,934 | A | 2/1987 | Carlson et al. |
| 4,646,802 | A | 3/1987 | Basore et al. |
| D290,538 | S | 6/1987 | Basore |

4,683,927 A 8/1987 Pyzer
4,697,357 A 10/1987 Van Vliet
4,706,845 A 11/1987 Schnurer et al.
4,715,572 A 12/1987 Robbins, III et al.
4,716,918 A 1/1988 Hayashida et al.
4,728,066 A 3/1988 Lang et al.
4,730,748 A 3/1988 Bane
4,738,478 A 4/1988 Bean, Jr.
4,747,701 A 5/1988 Perkins
4,752,008 A 6/1988 Pratt
4,759,518 A 7/1988 Yardas
4,779,794 A 10/1988 Moore
4,781,300 A 11/1988 Long
4,783,031 A 11/1988 Ebentheuer
4,784,248 A 11/1988 Workman
4,790,029 A 12/1988 LaFleur et al.
4,812,054 A 3/1989 Kirkendall
4,813,520 A 3/1989 Lin
4,815,784 A 3/1989 Zheng
4,825,892 A 5/1989 Norman
4,842,032 A 6/1989 Mastronardo
4,854,501 A 8/1989 Ricci
4,858,561 A 8/1989 Springer
4,858,634 A 8/1989 McLese
4,862,602 A 9/1989 Krill
4,876,829 A 10/1989 Mattick
4,895,230 A 1/1990 King
4,899,967 A 2/1990 Johnson
4,903,584 A 2/1990 Styles
4,925,102 A 5/1990 Jones et al.
4,940,200 A 7/1990 Sawyer et al.
4,946,118 A 8/1990 Hastings
4,948,077 A 8/1990 Gonzalez
4,951,333 A 8/1990 Kaiser et al.
4,953,815 A 9/1990 Beymer et al.
4,964,859 A 10/1990 Feldman
4,989,749 A 2/1991 Choi
4,995,487 A 2/1991 Plath
D315,432 S 3/1991 Smith
5,007,250 A 4/1991 Musielak
5,009,189 A 4/1991 Neff
5,011,008 A 4/1991 Baker
5,022,767 A 6/1991 Cardulla
5,024,262 A 6/1991 Huang
5,027,748 A 7/1991 Wolak
5,031,793 A 7/1991 Chen et al.
5,035,460 A * 7/1991 Huang ..... 296/95.1
5,036,999 A 8/1991 Bitsch
5,038,812 A 8/1991 Norman
5,054,507 A 10/1991 Sparks
5,072,828 A 12/1991 Irvine
5,082,219 A 1/1992 Blair
5,090,588 A 2/1992 Van Romer et al.
RE33,842 E 3/1992 Ebentheuer
5,116,138 A 5/1992 Macsenti et al.
5,118,201 A 6/1992 Cook
5,134,815 A 8/1992 Pickett
5,137,044 A 8/1992 Brady
5,143,283 A 9/1992 Lancaster
5,174,462 A 12/1992 Hames
5,195,649 A 3/1993 Wolters
5,213,147 A 5/1993 Zheng
5,222,513 A 6/1993 Hilliard
5,253,775 A 10/1993 Gould
5,263,672 A 11/1993 He
5,273,142 A 12/1993 Weber
5,301,705 A 4/1994 Zheng
5,324,490 A 6/1994 Van Vlahakis et al.
5,335,805 A 8/1994 Chen
5,356,024 A 10/1994 Ho et al.
5,358,440 A 10/1994 Zheng
5,375,267 A 12/1994 Davis
5,382,087 A 1/1995 Pouch
5,393,023 A 2/1995 Callan
5,394,897 A 3/1995 Ritchey et al.
5,411,046 A 5/1995 Wan
5,429,437 A 7/1995 Shaw et al.
5,437,384 A 8/1995 Farrell
5,437,410 A 8/1995 Babasade
5,449,083 A 9/1995 Dougherty et al.
5,464,113 A 11/1995 Ho et al.
5,467,794 A 11/1995 Zheng
5,468,061 A 11/1995 Friess et al.
5,472,280 A 12/1995 Rittmaster
5,474,196 A 12/1995 Fausel et al.
5,484,078 A 1/1996 Bronovicki
5,492,675 A 2/1996 Brizard
5,560,385 A 10/1996 Zheng
5,576,621 A 11/1996 Clements
5,593,046 A 1/1997 Katsuura et al.
5,620,069 A 4/1997 Hurwitz
5,664,596 A 9/1997 Zheng
5,664,886 A 9/1997 Hutchinson
5,671,479 A 9/1997 Dedrick
5,722,446 A 3/1998 Zheng
5,746,514 A 5/1998 Orensten
5,762,530 A 6/1998 Zheng
5,778,915 A 7/1998 Zheng
D397,756 S 9/1998 Hagerty
5,800,067 A 9/1998 Easter
5,816,279 A 10/1998 Zheng
5,816,954 A 10/1998 Zheng
5,827,104 A 10/1998 Zheng
5,845,697 A 12/1998 Zheng
5,853,313 A 12/1998 Zheng
D406,423 S 3/1999 Kellogg et al.
D407,765 S 4/1999 Zheng
5,901,926 A 5/1999 Zheng
5,906,290 A 5/1999 Haberkorn
5,910,038 A 6/1999 Zheng
5,910,058 A 6/1999 Zheng
5,927,793 A 7/1999 McGrath, Jr.
5,938,496 A 8/1999 Zheng
5,941,265 A 8/1999 Zheng
5,964,533 A 10/1999 Ziglar
5,967,357 A 10/1999 Kellogg et al.
5,971,188 A 10/1999 Kellogg et al.
5,971,410 A 10/1999 Nichols
5,975,101 A 11/1999 Zheng
5,992,045 A 11/1999 Kellogg et al.
5,992,676 A 11/1999 Tsai
6,006,772 A 12/1999 Zheng
6,059,912 A 5/2000 Kellogg et al.
6,088,953 A 7/2000 Morgan
6,089,394 A 7/2000 Ziglar
6,102,569 A 8/2000 Wang
D431,361 S 10/2000 Kellogg et al.
D433,810 S 11/2000 Kellogg et al.
D438,009 S 2/2001 Kellogg et al.
6,209,557 B1 4/2001 Zheng
6,220,998 B1 4/2001 Kellogg et al.
6,269,826 B1 8/2001 Zheng
D449,447 S 10/2001 Kellogg et al.
6,305,396 B1 10/2001 Zheng
6,311,709 B1 11/2001 Louie et al.
6,360,760 B1 3/2002 Louie et al.
6,363,955 B1 4/2002 Louie
6,390,111 B2 5/2002 Zheng
D461,638 S 8/2002 Kellogg et al.
RE37,924 E 12/2002 Kellogg et al.
6,494,335 B1 12/2002 Kellogg et al.
6,502,595 B2 1/2003 Louie
6,527,136 B1 3/2003 Sabounjian
6,585,414 B2 7/2003 Peska
6,702,119 B2 3/2004 Sabounjian
6,705,338 B2 3/2004 Zheng

| | | | |
|---|---|---|---|
| D494,367 | S | 8/2004 | Yang |
| RE38,591 | E | 9/2004 | Kellogg et al. |
| 6,874,797 | B2 | 4/2005 | Gardenour |
| 6,948,632 | B2 | 9/2005 | Kellogg et al. |
| D519,280 | S | 4/2006 | Kellogg et al. |
| 7,066,647 | B2 | 6/2006 | Peska |
| 7,077,147 | B2 | 7/2006 | Louie et al. |
| 7,111,634 | B2 | 9/2006 | Louie |
| 7,137,399 | B1 | 11/2006 | Ransom et al. |
| D536,872 | S | 2/2007 | Kellogg et al. |
| D547,950 | S | 8/2007 | Kellogg et al. |
| D551,452 | S | 9/2007 | Kellogg et al. |
| D555,854 | S | 11/2007 | Kamiya |
| D555,905 | S | 11/2007 | Kellogg et al. |
| D612,117 | S | 3/2010 | Krotts et al. |
| 2002/0112753 | A1 | 8/2002 | Louie |
| 2003/0213511 | A1 | 11/2003 | Louie |
| 2004/0129307 | A1 | 7/2004 | Louie et al. |
| 2006/0112621 | A1 | 6/2006 | White |
| 2007/0079548 | A1 | 4/2007 | Bakowski |

FOREIGN PATENT DOCUMENTS

| | | |
|---|---|---|
| DE | 2015649 | 2/1971 |
| DE | 30 13 178 | 11/1981 |
| DE | 41 14 916 | 11/1991 |
| FR | 589062 | 5/1925 |
| FR | 1215335 | 11/1959 |
| FR | 1380728 | 12/1964 |
| FR | 1380738 | 2/1990 |
| FR | 2635136 | 2/1990 |
| GB | 1367 | 5/1871 |
| GB | 5939 | 10/1915 |
| GB | 140570 | 4/1920 |
| GB | 2097244 A | 11/1982 |
| GB | 2126535 | 3/1984 |
| GB | 2212114 | 7/1989 |
| JP | 6-42227 | 2/1994 |

OTHER PUBLICATIONS

Playhut brochure, date unknown.
Eileen Edinger letter, dated May 25, 1993.
Eileen Edinger Douglas letter, dated Aug. 26, 1996.
Patent Application re: prior art product sold in U.S. by Stephen A. Fausel and Paul S. Ziglar; specification for Collapsible Furniture, Jun. 1985.
USPTO Office Action dated Oct. 10, 2000 regarding U.S. Appl. No. 09/574,757, 13 pages.
USPTO Office Action dated Apr. 7, 1999 regarding U.S. Appl. No. 09/108,521, 10 pages.
USPTO Office Action dated Mar. 22, 2000 regarding U.S. Appl. No. 09/393,956, 8 pages.
USPTO Office Action dated May 16, 2000 regarding U.S. Appl. No. 09/393,956, 7 pages.
USPTO Office Action dated Dec. 7, 2001 regarding U.S. Appl. No. 09/698,674, 33 pages.
USPTO Office Action dated Mar. 10, 2003 regarding U.S. Appl. No. 09/834,437, 5 pages.
USPTO Office Action dated Sep. 22, 2004 regarding U.S. Appl. No. 10/413,925, 5 pages.
USPTO Office Action dated Apr. 13, 2004 regarding U.S. Appl. No. 10/413,925, 6 pages.
USPTO Office Action dated July 2, 2004 regarding U.S. Appl. No. 10/413,925, 6 pages.
USPTO Office Action dated Jun. 23, 1999 regarding U.S. Appl. No. 09/262,904, 10 pages.
USPTO Office Action dated Oct. 14, 1999 regarding U.S. Appl. No. 09/262,904, 10 pages.
USPTO Office Action dated Feb. 7, 2000 regarding U.S. Appl. No. 09/262,904, 11 pages.
USPTO Office Action dated Feb. 7, 2002 regarding U.S. Appl. No. 09/644,894, 10 pages.
USPTO Office Action dated Apr. 4, 2002 regarding U.S. Appl. No. 09/644,894, 5 pages.
USPTO Office Action dated Jul. 30, 2002 regarding U.S. Appl. No. 09/644,894, 2 pages.
USPTO Office Action dated Oct. 6, 1998 regarding U.S. Appl. No. 09/114,370, 7 pages.
USPTO Office Action dated Mar. 2, 1999 regarding U.S. Appl. No. 09/114,370, 4 pages.
USPTO Notice of Allowance dated Nov. 23, 1999 regarding U.S. Appl. No. 09/173,079 (incl. Ex. Amt. & Interview Summary), 6 pages.
USPTO Office Action dated May 25, 2000 regarding U.S. Appl. No. 29/102,936, 5 pages.
USPTO Office Action dated Jun. 25, 1998 regarding U.S. Appl. No. 08/714,556, 18 pages.
USPTO Office Action dated Jan. 11, 1999 regarding U.S. Appl. No. 08/714,556, 15 pages.
USPTO Office Action dated Jan. 3, 2006 regarding U.S. Appl. No. 10/422,393, 6 pages.
USPTO Office Action dated Aug. 23, 2005 regarding U.S. Appl. No. 10/422,393, 6 pages.
USPTO Office Action dated Jun. 28, 2004 regarding U.S. Appl. No. 10/422,393, 7 pages.
USPTO Office Action dated May 28, 2008 regarding U.S. Appl. No. 11/063,091, 9 pages.
USPTO Office Action dated May 22, 2006 regarding U.S. Appl. No. 11/201,033, 10 pages.
USPTO Office Action dated Oct. 13, 2006 regarding U.S. Appl. No. 11/201,033, 12 pages.
USPTO Office Action dated Jun. 3, 2009 regarding U.S. Appl. No. 12/001,862, 10 pages.

* cited by examiner

Fig. 20A
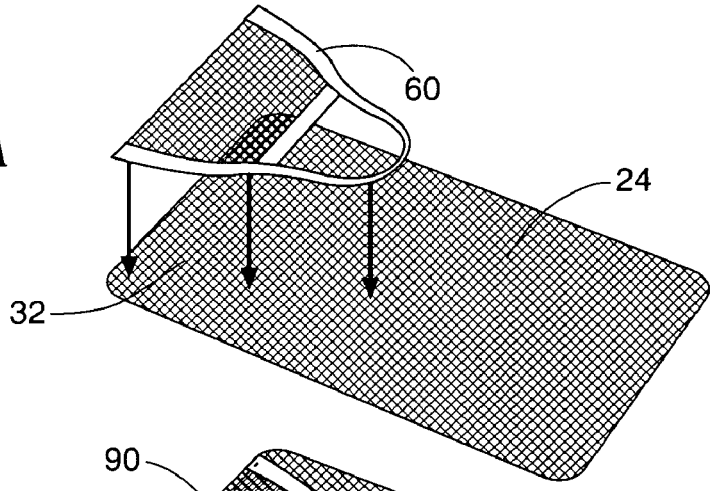
Fig. 20B
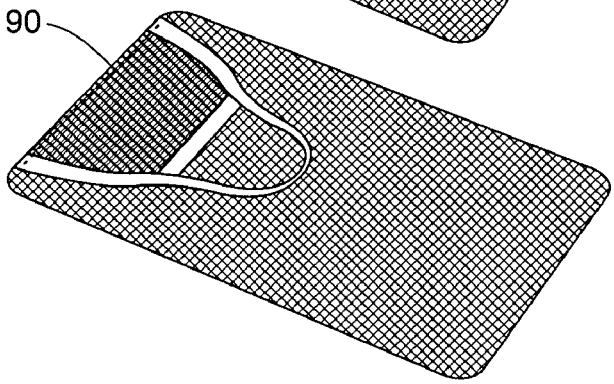
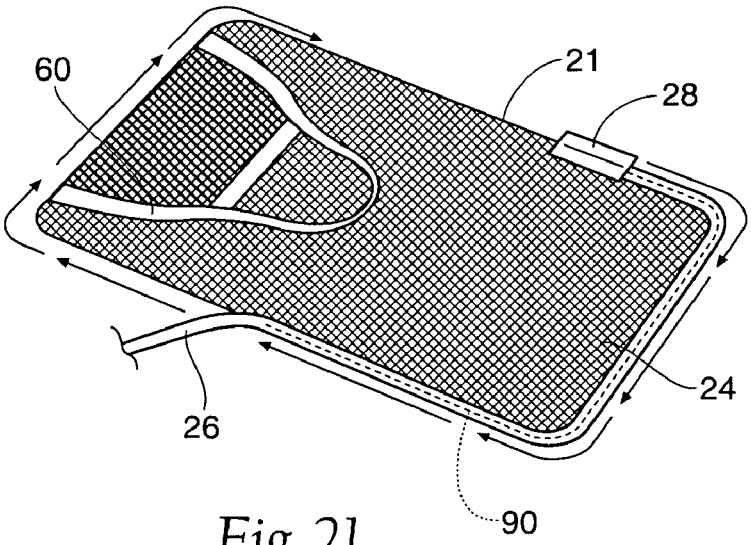
Fig. 21

COLLAPSIBLE CONTAINER HAVING DISCONTINUOUS FRAME MEMBERS

BACKGROUND OF THE INVENTION

The present invention relates generally to household products and specifically to a collapsible container and a method of making and using such a container for convenient storage and transportation of said products.

A typical household often encounters the need for temporary storage of garments prior to washing or cleaning. Regardless of the place where laundry or cleaning is done, either at home or in a commercial setting, soiled garments need to be sorted, stored, and eventually transported to a designated place. The present invention can be utilized for garment sorting, storage and transportation. At the same time, the present invention can also be used for other purposes, such as storage or transportation of toys or other objects. Accordingly, its use is not to be limited to storage or transportation of soiled garments.

Numerous devices are known in the art to provide effective storage of soiled garments, for example laundry baskets, conventional hampers, or clothing bags. For example, U.S. Pat. No. 2,625,973 to Weldon et al. teaches a laundry hamper comprising a rectangular frame having upper and lower portions that telescope within one another in a detachable manner. The lower portion includes a base frame, while the upper portion comprises a top frame. A cover is secured by a hinge to the top frame and an outer bag surrounds the rectangular frame. A plurality of small inner bags are provided within the outer bag. U.S. Pat. No. 1,581,888 to Thomas discloses a collapsible receptacle comprising two rectangular wire frames, hingedly secured together, means for holding the frames to form a triangularly shaped structure, and a fabric portion covering the frames and providing an enclosure. However, all these prior art devices are voluminous in their expanded state, are uneasy to fold or collapse, are still relatively voluminous in their collapsed state, and are difficult to manipulate.

The present invention solves the above-mentioned shortcomings and provides a convenient, easy to manipulate, and ergonomic means for storing or transporting garments or other objects.

SUMMARY OF THE INVENTION

A collapsible container according to the present invention includes a plurality of adjacent side panels, preferably four, each of which include a continuous, non-interrupted, planar web having a perimeter, and a frame member coupled to at least a portion of the perimeter. At least one of the panel frame members forms a discontinuous loop. Each of the side panels has a bottom side, a top side and two lateral sides, and is preferably generally rectangular in shape. The container further includes a floor panel having a plurality of sides, each of the sides being coupled to at least one side panel bottom side. Each of the lateral sides of each side panel is coupled to a lateral side of an adjacent side panel. One of the frame members forming a discontinuous loop may be a unitary member, or may comprise a plurality of members, perhaps two or three.

An embodiment of a collapsible container according to the present invention may provide each of the panel frames forming a discontinuous loop. In such a case, each frame may comprise a single, unitary member or a plurality of frame members, perhaps two or three.

An embodiment of a collapsible container according to the present invention may include at least one handle member, which is coupled to at least one of the side panels. Rather than being coupled to a side panel, a handle member may be formed by the formation of at least one aperture being formed at least partially within at least one side panel.

An embodiment of a collapsible container according to the present invention may include a storage pouch, which is coupled to one of said side panels, preferably near the open top of the container.

An embodiment of a collapsible container according to the present invention may include a flexible frame for each of said side panels.

An embodiment of a collapsible container according to the present invention may include a plurality of adjacent side panels. Each of the side panels may include a web having a perimeter, an edging attached to at least a portion of the perimeter of the web and forming a frame pocket, and a frame positioned at least partially within the frame pocket.

BRIEF DESCRIPTION OF THE DRAWINGS

FIGS. 20A through 26 depict a preferred method of manufacturing a collapsible container according to the present invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Prior advancements in collapsible containers have been made, for example, in U.S. Pat. No. RE37,924. Despite these prior advancements, all such prior containers utilize a continuous loop structure to frame a given flexible panel. While such structure may be desirable for some applications, it may be desirable in other applications to reduce the amount of framing material required to construct a collapsible container.

An embodiment 10 of a collapsible container according to the present invention is illustrated in FIGS. 1 through 6.

Figure 4:
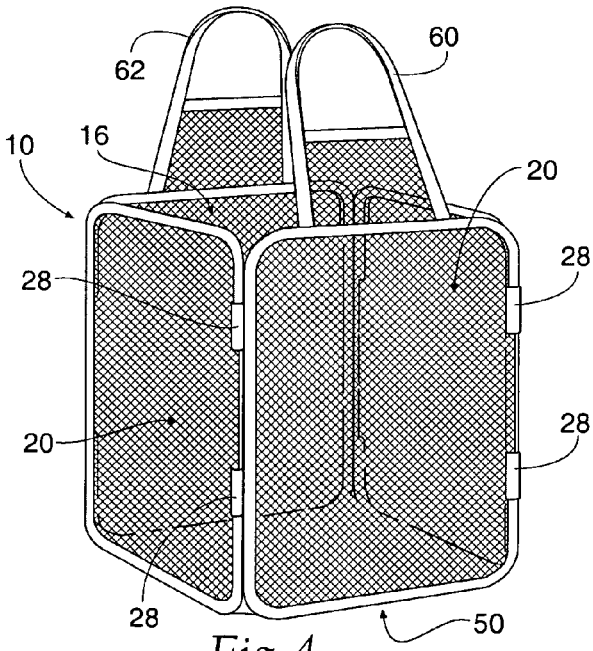
FIG. 4 is a perspective view of the embodiment of FIG. 1.

As shown in FIG. 4, the container 10 comprises a plurality of side panels 20 and a floor panel 50. The side panels 20, of which there are preferably four, may be of any desirable shape, but are preferably generally rectangular. The container 10 may further include two handles 60 and 62. The side and floor panels 20 and 50 are coupled to one another to form a generally parallelepiped container having an open top 16.

Figure 1:
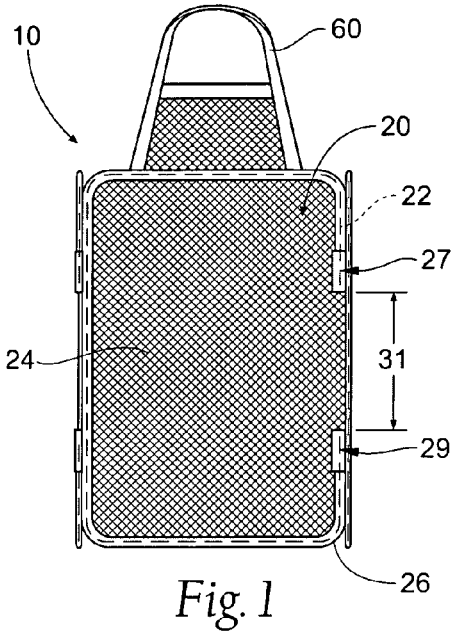
FIG. 1 is a front elevation view of a first embodiment according to the present invention.
Figure 2:
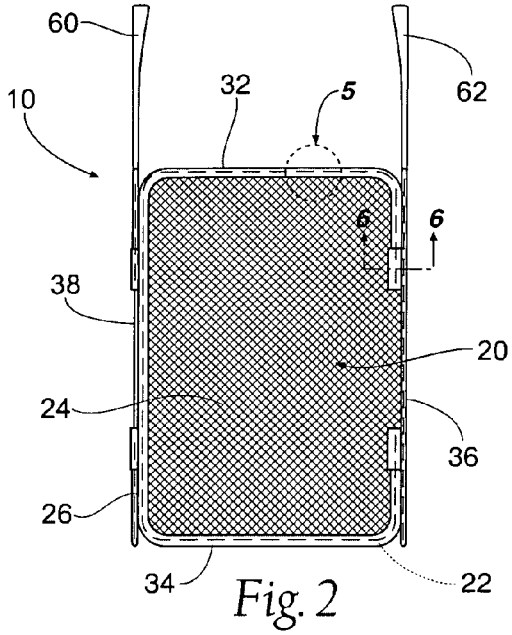
FIG. 2 is a right side elevation view of the embodiment of FIG. 1.
Figure 3:
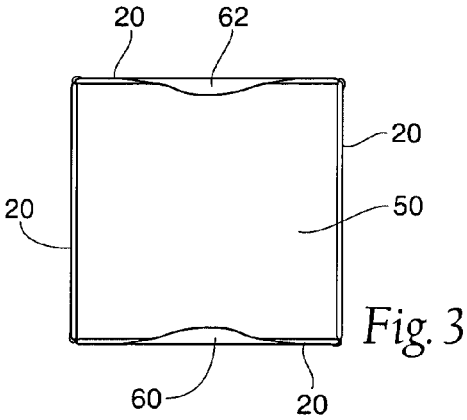
FIG. 3 is a top plan view of the embodiment of FIG. 1.
Figure 5:
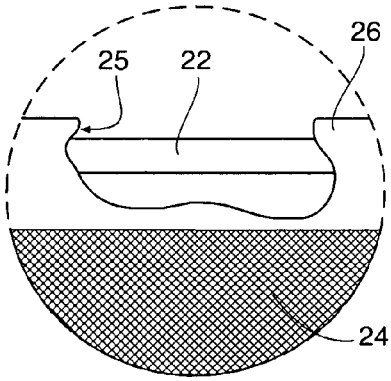
FIG. 5 is a partially cut-away view from FIG. 2 showing the frame member 22.
Figure 6:
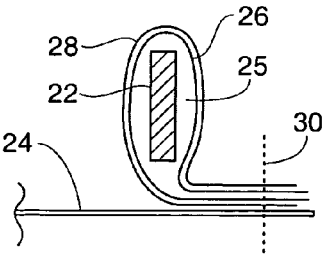
FIG. 6 is a partial cross-section view taken along line 6-6 in FIG. 2.

Referring to FIGS. 1 and 2, and as seen in detail in FIG. 5, each side panel 20 further comprises a frame 22, a web 24, and an edging 26. The frame 22 is flexible, preferably formed from a sufficiently stiff yet resilient material such as spring steel wire or plastic, and is contained within a channel or pocket 25 formed by the edging 26. The frame 22 of at least one panel 20 forms a non-continuous loop. Preferably, the frame 22 has a rectangular cross-section, but a material with a different geometric cross-section can be used. The web 24 is a flexible foldable material, such as nylon cloth or nylon mesh, but can be any suitably flexible material. The web 24 may be solid or perforated. The perimeter of the web 24 is coupled to the edging 26 such that the edging 26 forms a pocket 25 about the periphery of the web 24. The edging 26 is a foldable, preferably stretch-resistant material capable of housing the frame 22 within its pocket 25. The edging 26 has two ends 27 and 29. While the edging 26 is shown to be a separate component coupled to the web 24, the edging 26 may also simply be an extension of the web 24 having been folded upon itself to form the pocket 25. Pocket caps 28, also made out of a foldable stretch-resistant material, may be provided to cover the ends 27 and 29 of the edging 26, thereby protecting the frame 22 from escaping out of the edging 26. Each pocket cap 28 is preferably spaced from each other pocket cap 28 used on a given panel 20, thereby leaving at least one frameless section 31 on the panel 20, thereby reducing the amount of framing material required.

Figure 24:
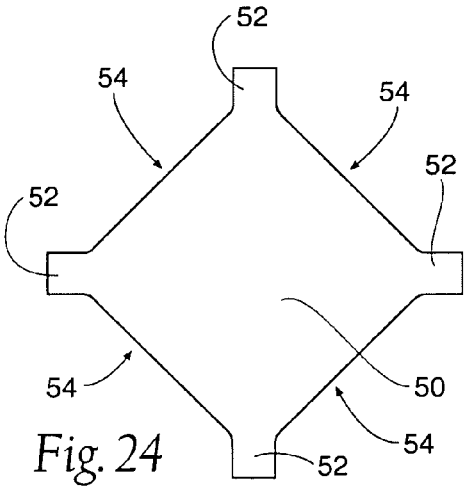
Figure 25:
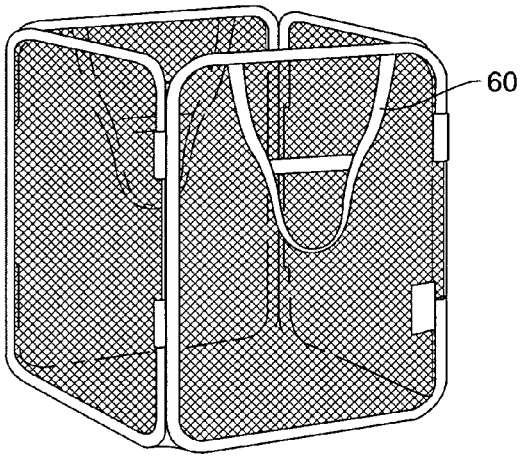

As can best be seen in FIG. 24, the floor panel 50 is also a foldable web of material and has a generally rectangular shape. The floor panel 50 has a plurality of coupling tabs 52 and a plurality of panel interface sections 54, which may be separated by the coupling tabs 52. The floor panel 50 may have the same number of coupling tabs 52 as the number of panels 20 forming the sides of the container 10. Each coupling tab 52 is adapted to be directly or indirectly coupled to two adjacent side panels 20, and each panel interface section 54 is adapted to be directly or indirectly coupled to one or more side panels 20. The floor panel 50 provides means for holding the garments or other objects (not shown) within the container 10 and for supporting the container 10 in its expanded state.

Returning to FIG. 2, each side panel 20 includes a top side 32 corresponding to the open top 16 of the container 10, a floor side 34 coupled to one of the panel interface sections 54 of the floor panel 50, and two lateral sides 36 and 38. Each lateral side 36 and 38 is directly or indirectly coupled to a corresponding lateral side 38 or 36 of an adjacent side panel 20.

Figure 7:
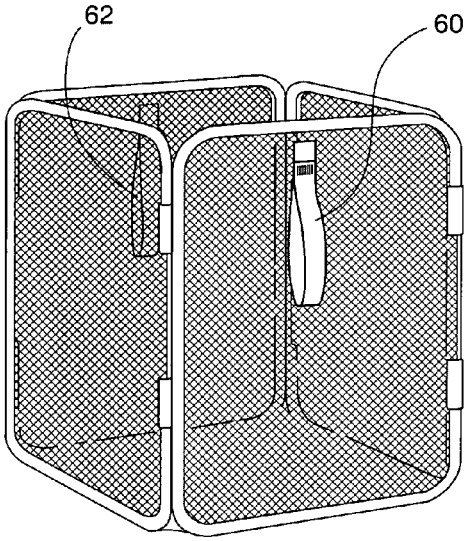
FIGS. 7-10 depict second, third, fourth and fifth embodiments of the collapsible container, respectively, namely showing different handle configurations.
Figure 8:
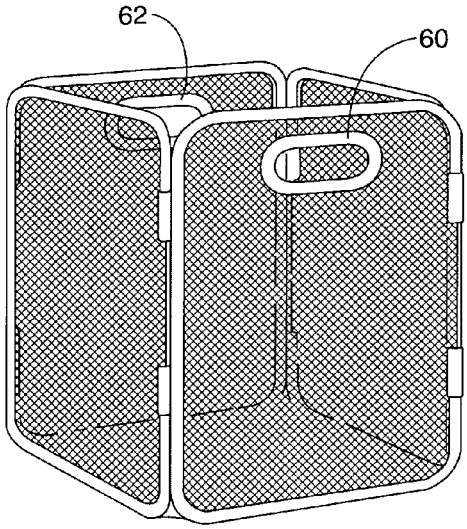
Figure 9:
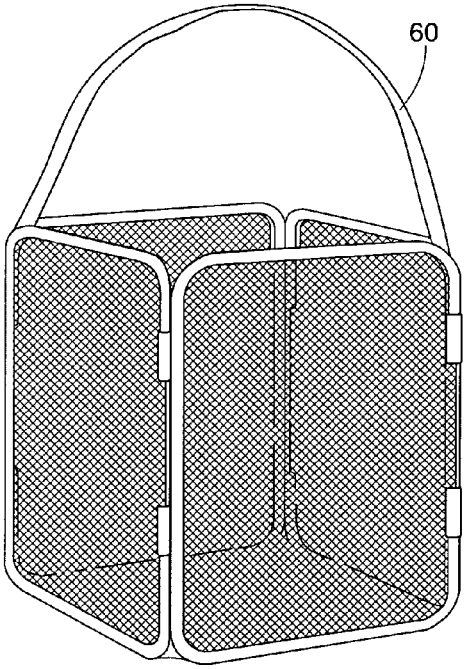
Figure 10:
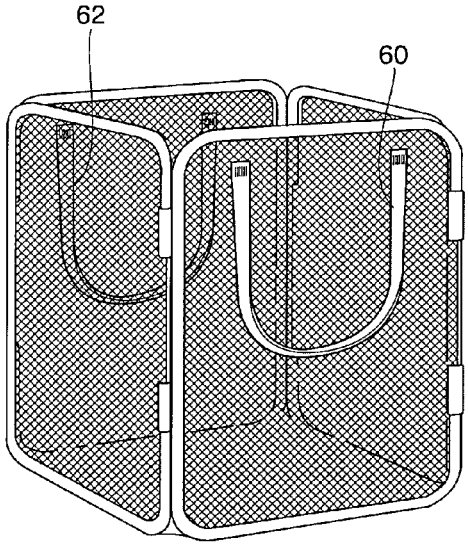

As depicted with respect to the first embodiment 10, the handles 60 and 62 have both ends connected to the top side 32 of two opposing side panels 20. The handles 60 and 62 are formed from a preferably stretch-resistant material having a mesh web that extends between a portion of each strap side. The handles for the present invention are not limited to such particular type. Several alternate embodiments are shown in FIGS. 7 through 10, illustrating different handle members. In FIG. 7, the handle members 60 and 62 are straps stitched to opposite side panels 20. FIG. 8 depicts an alternate embodiment wherein the handle members 60 and 62 are apertures or openings formed in the webs 24 of two opposite side panels 20. In FIG. 9, one handle member 60 is shown as a strap coupled to diagonally opposed seams between adjacent side panels. In FIG. 10, the handles 60 and 62 are preferably stitched directly to the webs 24 of two opposite side panels 20.

Figure 11:
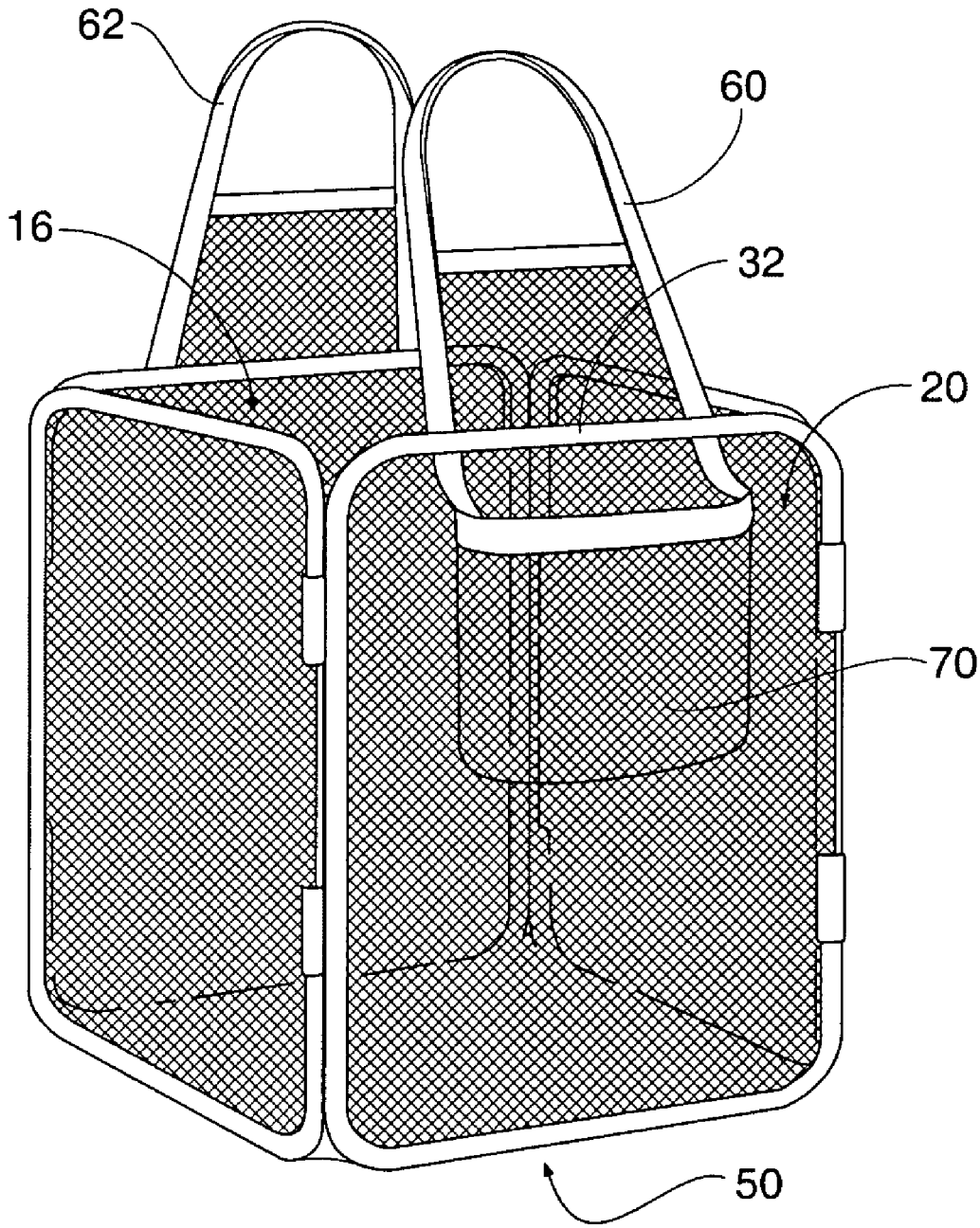
FIG. 11 is a perspective view of the embodiment of FIG. 1, further including a storage pouch.
Figure 12:
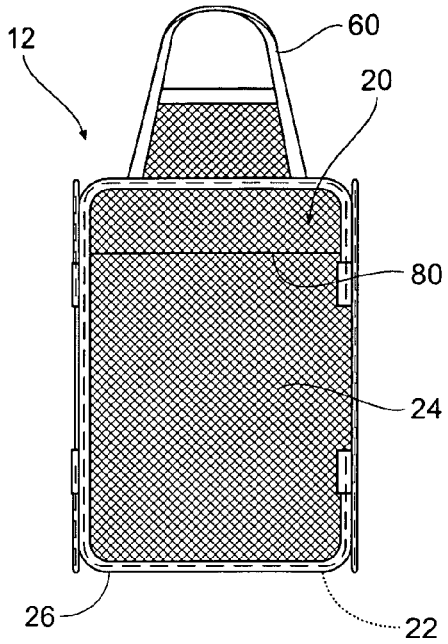
FIG. 12 is a front elevation view of a sixth embodiment of a collapsible container according to the present invention.
Figure 13:
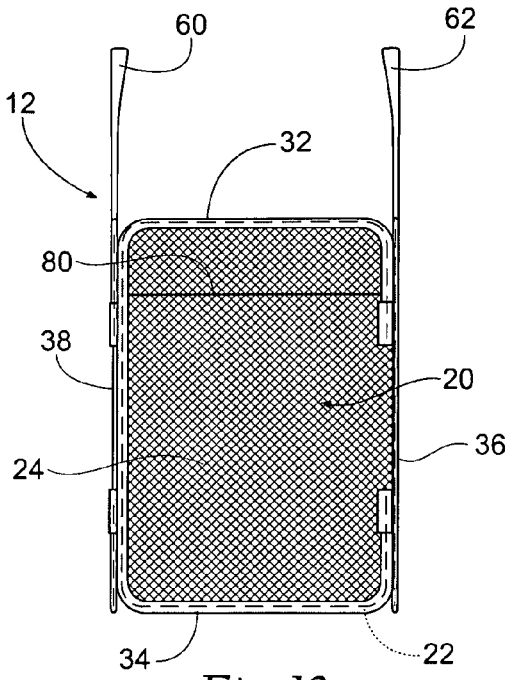
FIG. 13 is a right side elevation view of the embodiment of FIG. 12.
Figure 14:
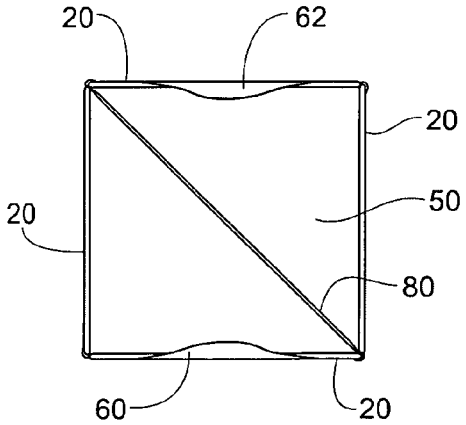
FIG. 14 is a top plan view of the embodiment of FIG. 12.
Figure 15:
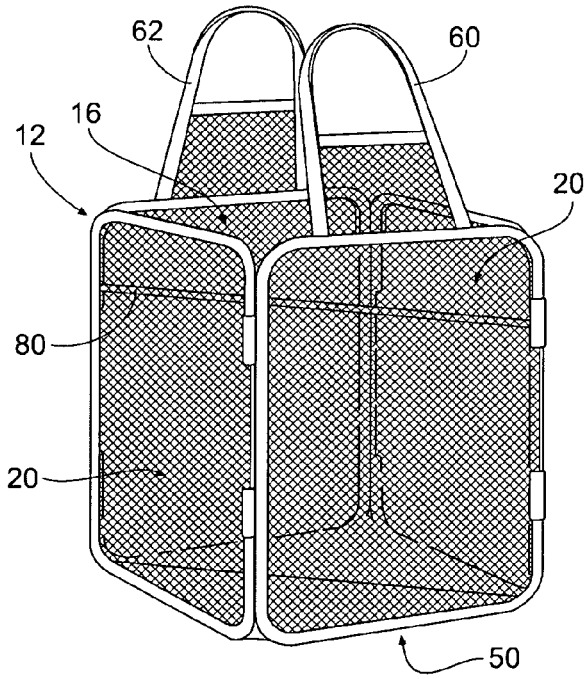
FIG. 15 is a perspective view of the embodiment of FIG. 12.
Figure 16:
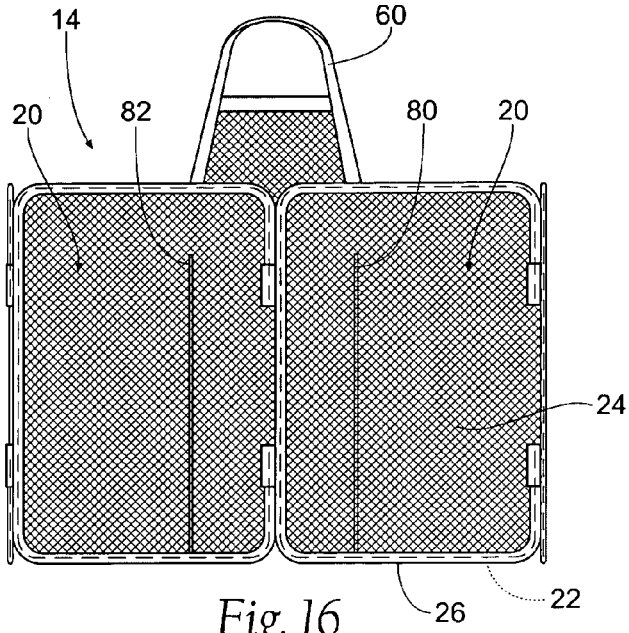
FIG. 16 is a front elevation view of a seventh embodiment of a collapsible container according to the present invention.
Figure 17:
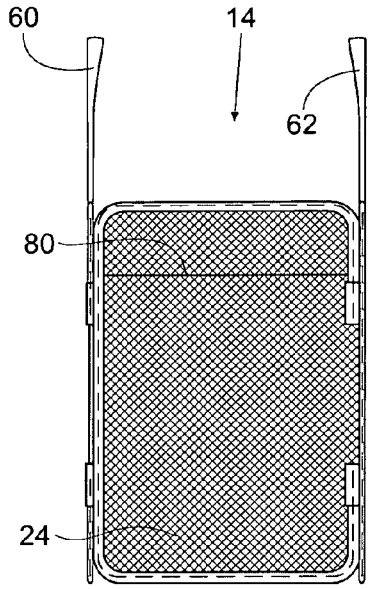
FIG. 17 is a right side elevation view of the embodiment of FIG. 16.
Figure 18:
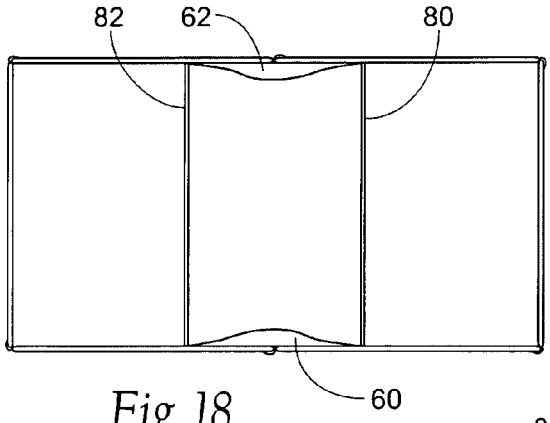
FIG. 18 is a top plan view of the embodiment of FIG. 16.
Figure 19:
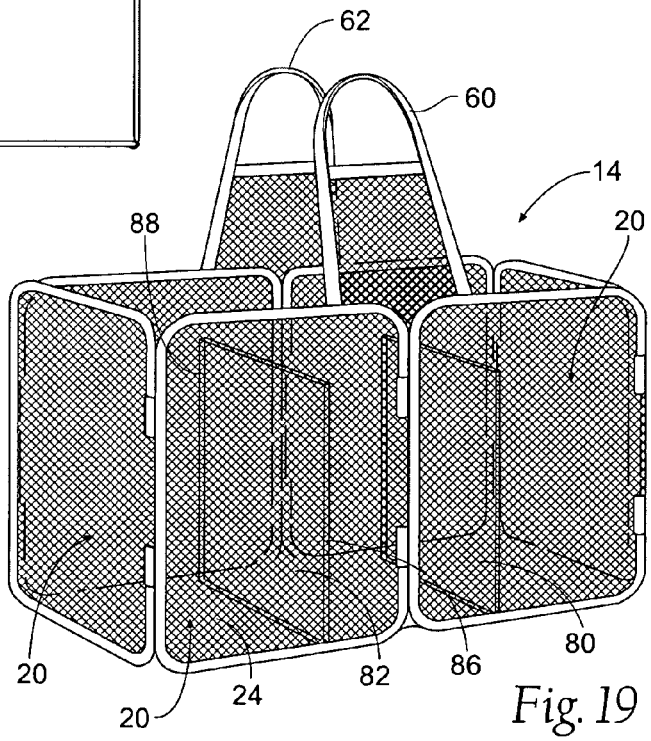
FIG. 19 is a perspective view of the embodiment of FIG. 16.

As shown in FIG. 11, a sixth embodiment of a collapsible container according to the present invention may include an optional storage pouch 70, which may be formed from a foldable material, such as nylon mesh, and coupled to one of the side panels 20. The storage pouch 70 may be dimensioned to accommodate the container 10 in its collapsed state as later described.

Although stitching is presented as the preferred means for directly coupling the elements of the container 10 and permitting relatively convenient folding of the container 10, it is to be understood that other methods can be used for directly coupling components in an embodiment of this invention. Such methods may include heat sealing, gluing and the like. Accordingly, construction of the collapsible container should not be limited to stitching alone.

FIGS. 12 through 15 depict a seventh embodiment 12 of a collapsible container according to the present invention. The container 12 further includes a divider panel 80. The divider panel 80 is coupled preferably to opposing portions of the container 12, thereby dividing the interior of the container 12 into two chambers.

FIGS. 16 to 19 show an eighth embodiment 14 of a collapsible container according to the present invention. The container 14 comprises six side panels 20 and two divider panels 80 and 82. The divider panels 80 and 82 are arranged preferably substantially parallel to one another. Each divider panel 80 and 82 is made out of a foldable material, such as nylon mesh, and has two sides 86 and 88 stitched to webs 24 of two opposite side panels 20. The divider panels 80 and 82 separate the interior of the container 14 into three compartments for improved sorting and storage of objects.

FIGS. 20A to 26 show various stages in the manufacturing process of the preferred embodiment of collapsible container 10. Referring to FIGS. 20A and 20B, the step of stitching the handle 60 to the top side 32 of a web 24 is shown. Specifically, the stitching is shown at 90. A second handle 62 may be coupled to a second web 24.

Figure 22:
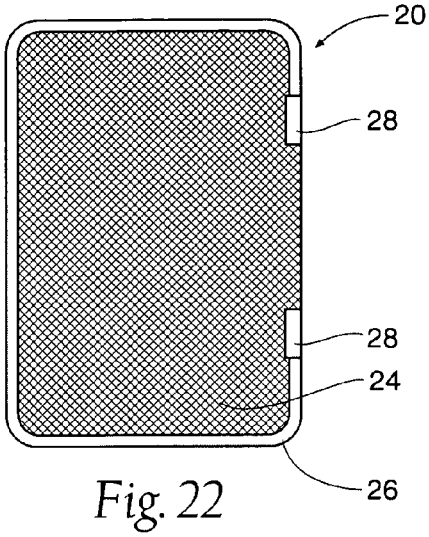
Figure 23:
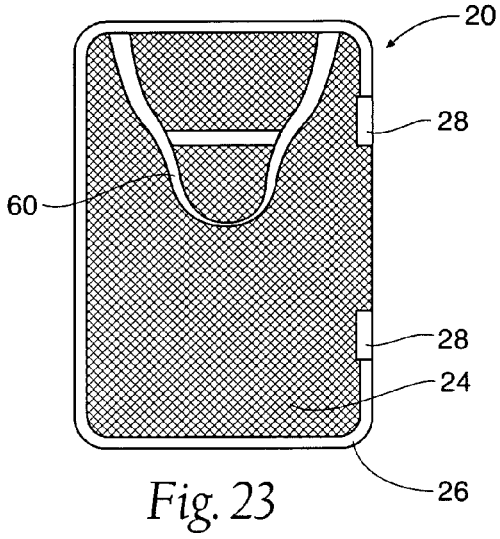

In FIG. 21, a pocket cap 28 is partially stitched to a side 21 of each of the plurality of webs 24. Each pocket cap 28 is preferably spaced from each other pocket cap 28 used on a given panel 20. The preferred aggregate spacing 31 between the caps 28, or length without having a frame member 22 located along a given side of a panel, may be as little as fifteen percent, or less, of the height of the panel 20 or as much as forty percent of the height of the panel 20, thereby reducing the amount of material required for the frame 22. As an example, a given side panel 20 having a height to width ratio of 2:1 would thus experience a decrease in frame material requirements over prior devices by about ten percent to about twenty-five percent or more. The edging 26 is then folded in a channel-like fashion around the periphery of the web 24 and stitched to the web 24. The stitched edging 26 forms a pocket 25 along at least a portion of the periphery of each web 24. In the preferred embodiment, the container 10 utilizes four panels 20. An example of a non-handled panel 20 is shown in FIG. 22, and an example of a panel 20 including the handle 60 is shown in FIG. 23.

Generally, after the desired plurality of panels 20 has been formed, the next step involves coupling the floor panel 50 to each of the side panels 20. The two side panels 20 containing the handles 60 and 62 should be positioned opposite each other with the handles 60 and 62 facing inwardly toward each other. First, the floor side 34 of each of the side panels 20 is stitched to one of the panel interface sections 54 of the floor panel 50. Next the lower portions of the lateral sides 36,38 of each of the side panels 20 is stitched to the coupling tabs 52 of the floor panel 50. The remaining portions of the lateral sides 36,38 are then coupled to corresponding adjacent side panel lateral sides 38,36, respectively.

Figure 26:
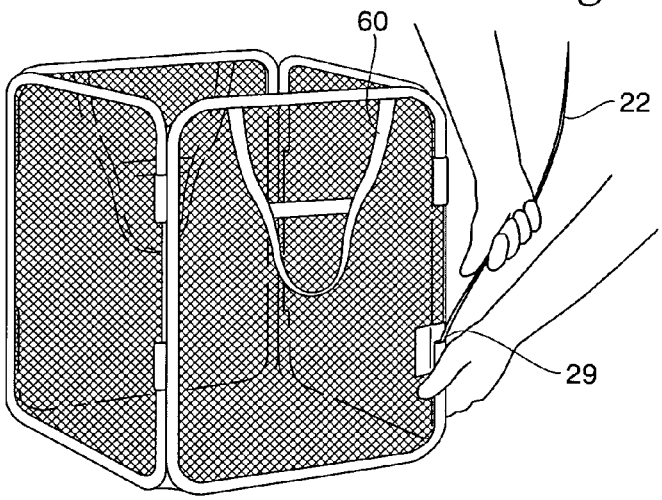

The final steps of the manufacturing process of a collapsible container according to the present invention involve inserting the frame 22 into each panel pocket 25 formed by each of the edgings 26 as shown in FIG. 26. The frame 22 is passed through the edging 26 and around at least a portion of the periphery of each of the side panels 20. Finally, any open pocket caps 28 are stitched or otherwise closed, thereby protecting the frame 22 from escaping the edgings 26.

Figure 27:
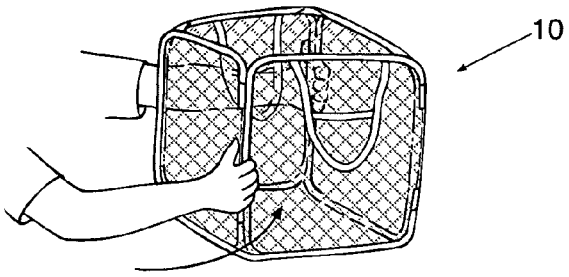
FIGS. 27 through 32 depict a method of collapsing a collapsible container according to the present invention.
Figure 30:
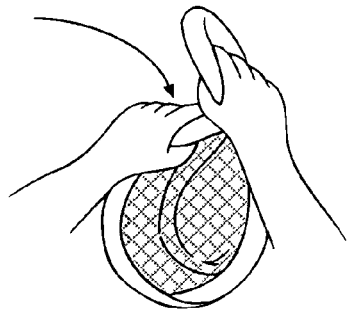
Figure 28:
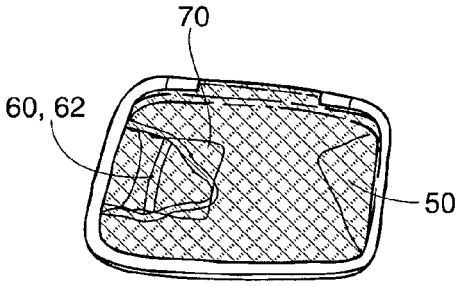
Figure 31:
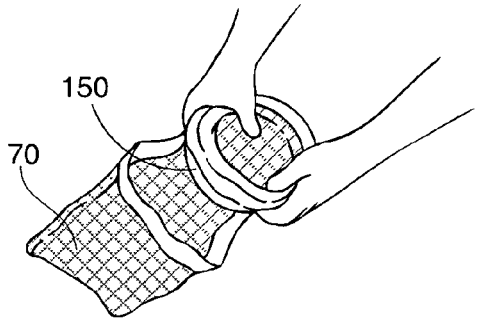
Figure 29:
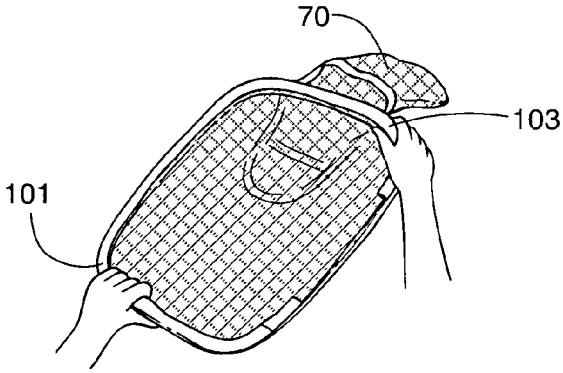
Figure 32:
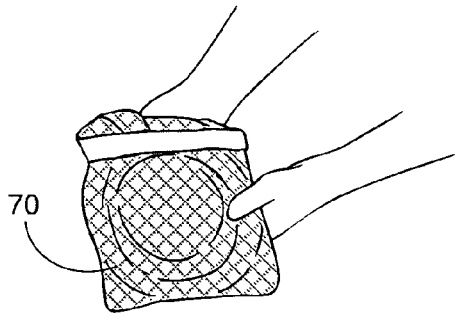

From the expanded state, the container 10 may be folded into a collapsed state for storage and transportation. FIGS. 27 to 32 show various steps for collapsing the container 10. Referring to FIG. 27, the first step requires grasping opposite sides of the container 10 and biasing one toward the other until all side panels 20 are adjacent and overlay each other. The next step includes inserting the handle members 60 and 62 and the floor panel 50 in between any two of the adjacent overlaying side panels 20 is shown in FIG. 28. If a storage pouch 70 is provided, it is important to make sure that the storage pouch 70 remains outside of the collapsed side panels 20. In the preferred embodiment, the resulting partially collapsed container 10 is a stack of four side panels 20. FIGS. 29 and 30 show the next step of rotating two opposite corners 101 and 103 of the partially collapsed container 10 in opposite directions while biasing the corners 101, 103 toward each other. The container 10 will first twist and then will rotate to form three overlaying circular loops 150 situated adjacently as shown in FIG. 31. The final step, shown in FIG. 32, is the insertion of the collapsed container 10 into the storage pouch 70.

When the collapsed container 10 is removed from the storage pouch 70, the frame members 22 will bias the panels 20 into their fully expanded state. Again, the fully expanded state of the preferred embodiment is that shown in FIG. 4.

Figure 33:
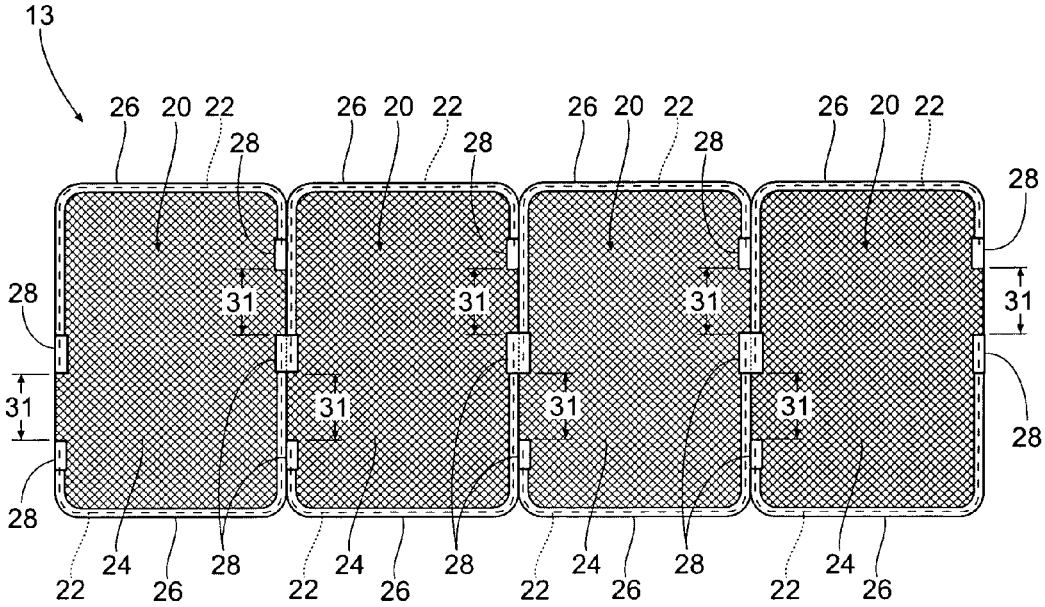
FIG. 33 depicts a partially assembled eighth embodiment of a collapsible container according to the present invention.

FIG. 33 provides a partially assembled eighth embodiment 13 of a collapsible container according to the present invention. Generally, this embodiment 13 includes a plurality of panels 20, including at least one frame 22 being discontinuous and divided into two panel support members, each panel support member being within a pocket formed by the edging 26 of the panel 20 and being located between two pocket caps 28.

Figure 34:
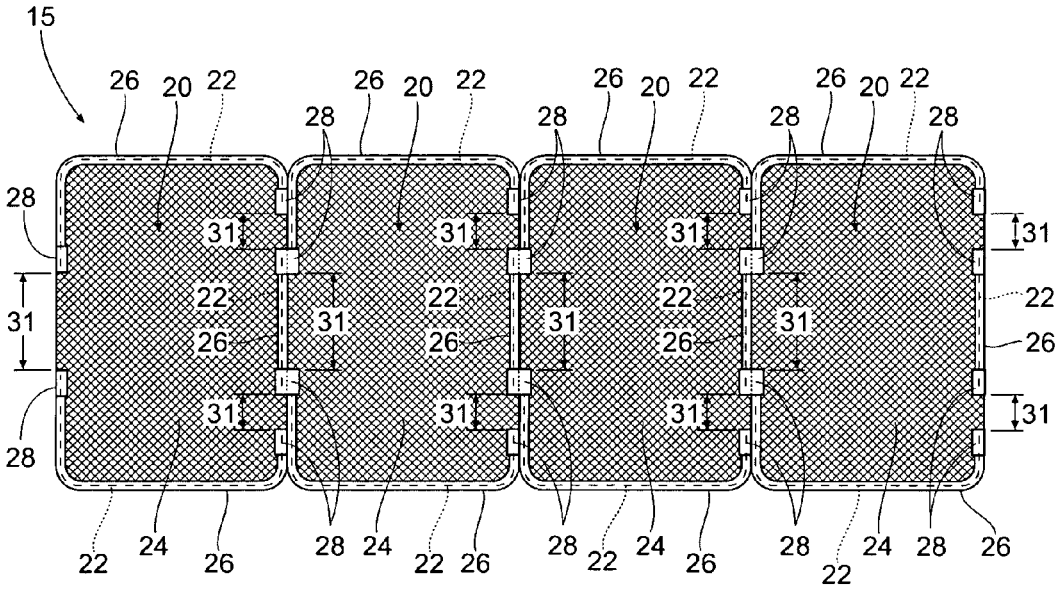
FIG. 34 depicts a partially assembled ninth embodiment of a collapsible container according to the present invention.

FIG. 34 provides a partially assembled eighth embodiment 15 of a collapsible container according to the present invention. Generally, this embodiment 15 includes a plurality of panels 20, including at least one frame 22 being discontinuous and divided into three panel support members, each panel support member being within a pocket formed by the edging 26 of the panel 20 and being located between two pocket caps 28.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A collapsible container comprising:

a plurality of adjacent side panels, each of said side panels including a continuous, non-interrupted, planar web having a perimeter, and a frame member coupled to at least a portion of said perimeter;

each of said side panels having a bottom side, and two lateral sides;

a floor panel having a plurality of sides, each of said floor panel sides being coupled to at least one of said side panel bottom sides;

each of said lateral sides of each side panel being coupled to a lateral side of an adjacent side panel; and at least one of said frame members forming a discontinuous loop having an open portion disposed between two frame member ends, wherein the frame member of one side panel is coupled adjacent to and spanning said open portion of an adjacent side panel.

2. A collapsible container according to claim 1, at least one of said frame members forming a discontinuous loop being a unitary member.

3. A collapsible container according to claim 1, at least one of said frame members forming a discontinuous loop comprising a plurality of panel support members.

4. A collapsible container according to claim 3, said plurality of panel support members comprising two panel support members.

5. A collapsible container according to claim 3, said plurality of panel support members comprising three panel support members.

6. A collapsible container according to claim 1, each of said frame members forming a discontinuous loop.

7. A collapsible container according to claim 6, each frame member being a unitary member.

8. A collapsible container according to claim 6, each frame comprising a plurality of panel support members.

9. A collapsible container according to claim 8, said plurality of panel support members comprising two panel support members.

10. A collapsible container according to claim 8, said plurality of panel support members comprising three panel support members.

11. The collapsible container of claim 1, further comprising at least one handle member, said handle member being coupled to at least one of said side panels.

12. The collapsible container of claim 1, further comprising at least one aperture being formed at least partially within at least one side panel.

13. A collapsible container having an open top, said collapsible container comprising:

a plurality of adjacent side panels, each of said side panels including a web having a perimeter, an edging attached to at least a portion of the perimeter of the web and forming a frame pocket, and a frame;

the frame being positioned within the pocket;

each of said side panels having a bottom side and two lateral sides;

a floor panel having a plurality of sides, each of at least two of said floor panel sides being coupled to at least one of said side panel bottom sides;

each of said lateral sides of each side panel being coupled to a lateral side of an adjacent side panel; and at least one of the frames forming a discontinuous loop having an open portion disposed between two frame ends, wherein the frame of one side panel is coupled adjacent to and spanning said open portion of an adjacent side panel.

14. A collapsible container according to claim 13, at least one of said frame members forming a discontinuous loop being a unitary member.

15. A collapsible container according to claim 13, at least one of said frame members forming a discontinuous loop comprising a plurality of panel support members.

16. A collapsible container according to claim 15, said plurality of panel support members comprising two panel support members.

17. A collapsible container according to claim 15, said plurality of panel support members comprising three panel support members.

18. A collapsible container according to claim 13, each of said frame members forming a discontinuous loop.

19. A collapsible container according to claim 18, each frame members being a unitary member.

20. A collapsible container according to claim 18, each frame member comprising a plurality of panel support members.

21. A collapsible container according to claim 20, said plurality of panel support members comprising two panel support members.

* * * * *